United States Patent [19]

Andris

[11] Patent Number: 4,979,646

[45] Date of Patent: Dec. 25, 1990

[54] PASTE DISPENSER

[76] Inventor: Raimund Andris, Tannhörnle 9, D-7730 Villingen-Schwenningen 22, Fed. Rep. of Germany

[21] Appl. No.: 432,795

[22] Filed: Nov. 7, 1989

[30] Foreign Application Priority Data

Nov. 7, 1988 [DE] Fed. Rep. of Germany ..... 3837704

[51] Int. Cl.[5] ..... B65D 83/00; A47K 5/00

[52] U.S. Cl. ..... 222/136; 222/145; 222/207

[58] Field of Search ..... 222/136, 145, 207, 214, 222/256, 257, 492; 137/508

[56] References Cited

U.S. PATENT DOCUMENTS

| | | | |
|---|---|---|---|
| 4,732,549 | 3/1988 | von Shuckman | 222/153 |
| 4,846,372 | 7/1989 | von Shuckman | 222/136 |
| 4,903,868 | 2/1990 | Ichiharget et al. | 222/256 |

*Primary Examiner*—Andres Kashnikow
*Assistant Examiner*—P. Derakshani
*Attorney, Agent, or Firm*—McGlew and Tuttle

[57] ABSTRACT

A paste dispenser includes a dispensing pump for dispensing metered amounts of pasty substances, such as toothpaste or the like, from bottle-like or can-like paste containers which have a bellows made of an elastic material. The bellows are arranged between two housing parts which are made of a dimensionally stable material, guided telescopically resiliently one with another, so as to establish communication between the housing parts. One of the housing parts is provided with a tubular discharge orifice which shapes a strand of paste, and communicates with an annular duct formed by two inner and outer sections which are formed on one of the housing parts and are concentric to one another and coaxial to a bellows axis intercommunicating the housing parts. The inner tube section is surrounded by a radially elastic annular wall member or portion of the bellows which forms a valve seat. The annular wall section joins a wall of the bellows in a sealing fashion between the outer and inner sections. The end of the annular wall member rests on the inner surface of the outer tube section. To add colored paste with the sharpest contours possible to the strand of paste, the inner tube section is provided, in order to be used as a reservoir for a color-stripping paste, with one or several striping ducts open directly into said discharge orifice.

8 Claims, 1 Drawing Sheet

FIG. 1
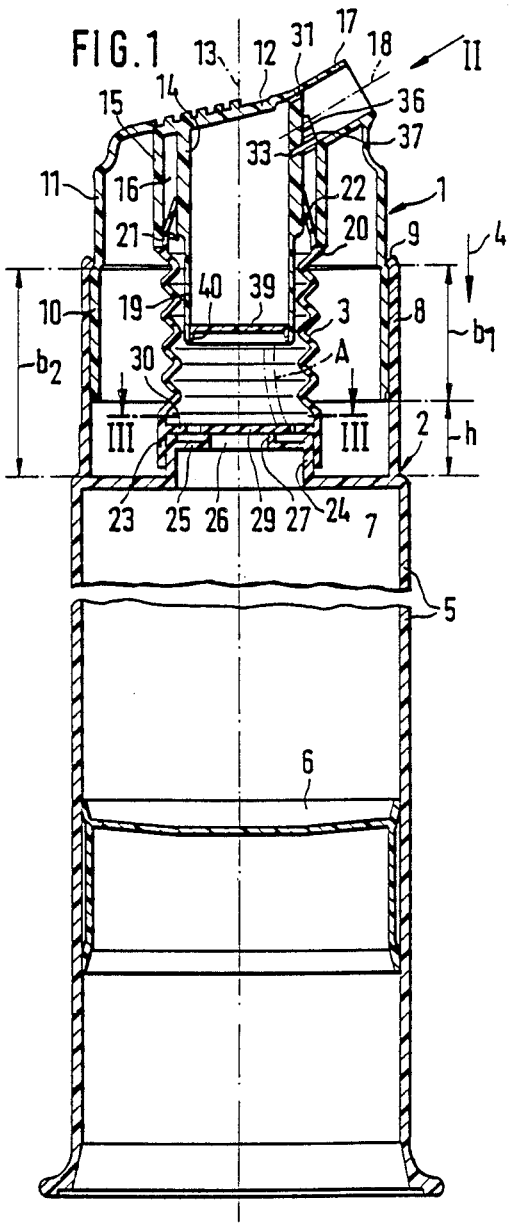
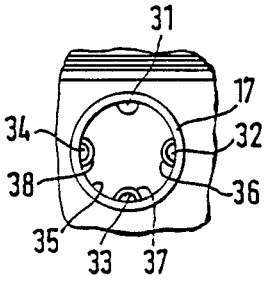
FIG. 2
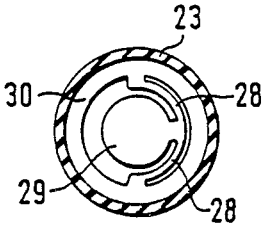
FIG. 3

PASTE DISPENSER

BACKGROUND OF THE INVENTION

Field of the Invention

This invention relates in general to dispensers for pasty material and in particular to a new and useful paste dispenser which includes front and rear relatively movable tubular dispensing portions which are telescopically interengaged and include both a pasty material dispenser reservoir and a striping material dispensing reservoir which are interconnected in a discharge orifice.

The present invention pertains in particular to a paste dispenser with a dispensing pump for discharging metered amounts of substances of low viscosity, especially pasty substances, such as toothpaste, ointments, and the like. Such a device includes a bottle-like or can-like paste container, having bellows made of an elastic material arranged between two housing parts made of a dimensionally stable material such as plastic. The bellows establishes communication between housing parts which engage with one another telescopically in the axial direction and can be moved relative to one another between two stroke limiting paths and can be returned by axial return resilient forces. One of the housing parts is provided with a tubular discharge orifice which shapes a strand of paste. The discharge orifice communicates with an annular canal which is formed by two radially spaced apart tube sections on a housing part which are arranged concentrically to one another and coaxially to the axis of the bellows. The tube sections are open only at their respective end faces and the inner tube section is surrounded by a radially elastic, sleeve-like annular wall section of the bellows in the form of a valve seat. The annular wall section joins a wall section of the bellows which is in contact with the inner surface of the outer tube section in a sealing fashion. The second housing part is provided with a paste reservoir.

To squeeze paste out of the paste container through the discharge orifice, most of the prior-art paste dispensers are provided either with a displacing plunger in conjunction with a tracking plunger or with a thrust plunger, and the displacing plunger or the thrust plunger is gradually displaced in the direction of discharge by a pushbutton-like or lever-like, manually operated actuating member within the container. Due to the use of a displacing plunger in conjunction with a tracking plunger or of a thrust plunger, which is actuated by means of a pushrod via a guiding locking mechanism, it is possible to eliminate the use of pump valves in such paste dispensers. As a result, such paste dispensers can be manufactured relatively simply and inexpensively as described in West German Offenlegungsschrift No. 35,07,355, DE-OS West German Offenlegungsschrift No. 33,04,926, U.S. Pat. Nos. 4,120,431, 3,255,935, and British Patent No. 2,172,664 A.

In such paste dispensers, an additional striping paste of a different color can be added in a relatively simple manner in the form of a stripe to the strand of paste passing through the discharge orifice. It is only necessary to provide—in the area in which the discharge duct opens into the container—an annular wall, around which the striping paste is arranged, and to provide this annular wall with radial holes, through which the striping paste is introduced in the form of thin stripes into the discharge duct and consequently into the actual strand of paste.

In a paste dispenser of the type described here, in which bellows are arranged as a pumping member between the reservoir containing the medium to be dispensed and the discharge orifice, the striping paste cannot be added in the form described to the strand of paste, because the discharge orifice or its discharge duct, in which the strand of paste is shaped, does not reach into the paste reservoir.

SUMMARY OF THE INVENTION

The present invention provides, in the simplest manner possible, a color-striping paste in the form of a plurality of stripes to the strand of paste leaving the discharge orifice or to the paste passing through the discharge duct and into said discharge orifice via the annular duct, so that the color stripes formed in the strand of paste have the sharpest contours possible.

According to the present invention the inner tube section is used for a reservoir for a color-striping paste, with one or several striping ducts arranged in the area of the discharge orifice, which open directly into the discharge orifice.

Since the striping ducts are prepared in an inner tube or section in the form of radial holes or openings which communicate directly with the discharger during the injection molding, these striping ducts cause no additional manufacturing costs, aside from the slightly higher cost of the dies.

Since it has already been common practice to arrange the discharge orifice radially or obliquely relative to the axis of the housing and extending radially at the end of one of the housing parts that is turned away from the paste dispenser in respect to dispensers described e.g. in West German Offenlegungsschrift No. 35,09,178 and European Patent Application No. 88,10,93 67.8, it is also inherently possible to keep the discharge orifice relatively short and thus to ensure very sharp contouring of the color stripes.

The storage capacity of the tube section for the striping paste needed can be increased to the required amount without difficulty.

If the discharge orifice is positioned at right angles radially to the axis of the tube section, the striping ducts open directly into the discharge duct of the discharge orifice rather than into the annular duct surrounding the inner tube section. This construction is also important for producing sharply contoured stripes in the strand of paste.

In paste dispensers of the class according to the present invention, the interior of the bellows can be easily caused to communicate directly with the paste dispenser if the paste dispenser is provided with a tracking plunger that is prevented by a guiding locking mechanism, e.g., in the form of a spring locking disk, from moving in the direction of the bottom of the container. It is therefore also possible to fill the inner tube or section with striping paste with ease when fitting together of the two housing parts and the bellows. This is done by introducing the striping paste with a tube or a flexible tube that is introduced into the interior of the inner tube section through the junction between the bellows and the reservoir from the bottom side of the reservoir. However, this has to happen before the paste container is filled with the paste and before the tracking plunger is placed into the container from the bottom side.

However, it is also possible to provide a tracking plunger without guiding locking mechanism in the paste container if a suction valve is arranged between the bellows and the paste reservoir. This embodiment of the present invention is provided in order to enable the inner tube section to be filled with striping paste in this case as well on fitting together of the two housing parts and the bellows.

Contrary to this, the inner tube section can be filled with striping paste even before the two housing parts and the bellows are assembled. This means that the suction valve may be provided with any closing member. A construction is possible which guarantees that the striping paste filled in will not flow out of the inner tube section during the transportation and assembly of the two housing parts and the bellows. The plunger used in such a case may consist of a simple circular disk provided with a guiding edge.

Accordingly, it is an object of the invention to provide a dispenser for pasty material which includes an arrangement for a reservoir of both the pasty material and a striping material which is to be joined to the pasty material and which has improved means for causing the striping material to be joined to the pasty material at a discharge conduit.

A further object of the invention is to provide a material dispensing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a sectional view of a paste dispenser constructed in accordance with the invention;

FIG. 2 is a partial view in the direction of arrow II in FIG. 1; and

FIG. 3 is a section taken along the line III—III of FIG. 1.

DESCRIPTION OF THE PREFERRED EMBODIMENTS

The paste dispenser shown in the drawing includes two housing parts or sections 1 and 2, each of which is made in one piece from a dimensionally stable material such as plastic. A bellows 3 is arranged between the two housing parts 1 and 2 to establish communication between them in the manner to be described in greater detail below. Contrary to the two housing parts 1 and 2, the bellows 3 is formed of a material such as a rubber-like elastic or soft plastic, so that it is axially compressible and capable of generating the restoring forces needed for suction, which forces return housing part 1 into its starting position as shown in FIG. 1 after a dispensing stroke is performed in the direction of arrow 4.

Housing part 2 includes a cylindrical paste reservoir 5 molded in one piece, which accommodates a tracking plunger 6, which is introduced into the reservoir from the open bottom side of the paste reservoir. Above a radially extending front wall 7, the housing part 2 is provided with an upper or outer cylindrical guide sleeve 8. The guide sleeve 8 has an upper end with an inwardly projecting annular rib 9. A cylindrical guide section or skirt 10 of the housing part 1, whose length b1 is approximately one third shorter than the axial length b2 of the guide sleeve 8, is movably guided in said guide sleeve 8. Consequently, the housing part 1 is telescopically movable in the guide sleeve 8 by the stroke height h. The external diameter of the guide section 10 of the housing part 1 is adjusted to the internal diameter of the guide sleeve 8 such that nearly clearance-free guiding is guaranteed between these two parts.

The annular rib 9 at the upper end of said guide sleeve 8, and said front wall 7 at the lower end of said guide sleeve form a stroke limiting means for the housing part 1 and for the guide section 10, respectively. The likewise cylindrical head part 11 of the housing part 1, which joins the guide section 10 in the upward direction, has an external diameter that corresponds to the internal diameter of the annular rib 9, and it is provided with a closed front wall 12. An inner tube section or part 14 and an outer tube section or part 15, which together form an annular duct 16, are molded on the front wall 12 concentrically to the common housing axis 13 and at radially spaced locations from one another. The annular duct 16 directly communicates with a discharge orifice 17 whose axis 18 extends obliquely radially relative to the housing axis 13. The lower open end of the outer tube section 15 terminates within the head part 11, but the outer tube section 14 has an extension 19 which has a reduced diameter and a smaller wall thickness and extends over approximately half of its length into the bellows with a radial clearance. Due to the extension 19, the tube section 14 has the necessary storage capacity for a color-striping paste. The color-striping paste is added in the form of stripes to the strand of paste removed from paste reservoir 5, and it differs from the paste contained in the paste reservoir 5 at least in its color.

The top end section of the bellows 3 is provided with a flange-like thrust ring 20, which is in supporting contact with the lower, end-face annular surface of the outer tube section 15. The thrust ring 20 is joined by a cylindrical section 21, which is in sealing contact with the inside of said outer tube section 15 and on which a conical annular wall section 22 is molded, which latter is in sealing contact with the external jacket surface of the inner tube section 14 in the form of a valve seat. Depending on the elasticity of the material of which the bellows 3 is made, the wall thickness of said conical annular wall section 22 is selected such that upon a pumping stroke of the housing part 1 in the direction of arrow 4, part of the paste contained in the bellows 3 can flow through between the annular wall section 22 and the jacket surface of the tube section 14, and reach the annular duct 16 and therefrom the discharge orifice 17. Thus, the annular wall section 22 of the bellows 3 forms, in cooperation with the tube section 14, the discharge-side pump valve, which opens under pressure during the dispensing stroke and closes during the subsequent suction stroke.

With a cylindrical end section 23, the lower end of the bellows 3 facing the front wall 7 of the housing parts is placed on and sealed against a cylindrical ring type nipple 24 of the front wall 7 which nipple is concentric to the housing axis 13. The ring nipple 24 has a somewhat larger diameter than the inner tube section 14 and is provided with an annular wall 25 that is offset relative to the annular wall 7 and has a cylindrical opening 26 with a valve seat 27 in the form of an upwardly directed annular rib that concentrically surrounds the opening 26.

The closing member or circular valve flap 29, which is connected in one piece with a front wall ring 30 of the bellows 3 via a cut-free, semicircular ring web 28, is molded on the cylindrical end section 23 of the bellows 3 in the plane of the valve seat ring 27. The valve flap 29 rests on the valve seat ring 27, closing it off when the housing part 1 performs a pressing or dispensing stroke in the direction of arrow 4. It lifts off from the valve seat ring 27 when the housing part 1 performs the opposite suction stroke and returns into its starting position shown in FIG. 1.

However, due to the cut-free ring web 28, the valve flap 29 is also able to move away into position A indicated by dash-dotted lines when a flexible tube or a pipe is pushed through the opening 26 into the tube section 14 from the still empty paste reservoir 5 to fill the tube section 14 with color-striping paste. It would also be possible to replace the valve flap 29 as the valve closing means, which can be turned away, with a member that can be introduced into the opening 26 after filling of the tube section 14 with color-striping paste.

In order to ensure that the striping paste filled into the tube section 14 can be added in the form of sharply contoured, thin, visible strips to the strand of paste formed in the discharge orifice 17, the tube section 14 is provided in the area of the discharge orifice 17 with four striping ducts 31, 32, 33, and 34, Which are arranged at 90° relative to each other, and are molded along or in the extension of the inner contour 35 of the discharge orifice 17 such that they have the same direction as the axis 18. While the upper striping duct 31 comprises only a hole passing through the wall of the tube section 14, the striping ducts 32, 33, and 34 are extended by radial projections 36, 37, and 38 toward the discharge orifice 17, so that they span over the width of the annular duct 16 and open into this duct. It is thus ensured that the strands of striping paste flowing into the discharge orifice 17 through the striping ducts 31 through 34 will be embedded in the main strand of paste with sharp contours and be clearly visible as straight stripes on its circumference. The projections 36, 37, and 38 prevent the paste that continues to flow from the annular duct 16 into the discharge orifice 17 from effacing the contour of the thin strands of striping paste.

While it is possible in the above-described paste dispenser due to the valve flap 29 that can be turned away to fill the cavity of the tube section 14 with striping paste after assembly of the two housing parts 1 and 2 in the form shown together with the bellows 3 by filling the striping paste into the tube section 14 by means of a flexible tube or pipe that is introduced through the open, still empty reservoir 5 via the opening 26, it is also possible to fill the tube section 14 with the striping paste even before the assembly with the bellows 3 and/or the housing part 2. A plunger 39 in the form of a circular disk having a guiding edge 40 is provided in this case, and the plunger is introduced into the tube section, and it progressively penetrates into the guiding tube section 14 on each dispensing stroke.

Since the opening 26 is closed by the valve flap 29 during the dispensing stroke of the housing part 1, the tracking plunger 6 in the reservoir 5 does not require a locking mechanism that would prevent it from moving downward toward the open end of the reservoir. However, if a tracking plunger 6 is equipped with such a locking mechanism, a suction valve or a valve closing flap or another closing member in the area of the opening 26 can be omitted.

The inner tube section 1 has a total of three functions: it serves as a reservoir for the striping paste; it serves as a valve seat ring for the conical, radially elastic annular wall section 22 of the bellows 3, and as long as it still contains a certain amount of striping paste, it acts as a displacing body within the bellows 3.

Since the pressure occurring in the bellows 3 during a dispensing stroke always acts in the same relation on the striping paste contained in the open tube section 14 as well, it is also ensured that constantly equal amounts of striping paste are always added to constantly equal amounts of the other paste. This is an advantage arising from the constant cross section and pressure ratios.

The device according to the present invention can also be realized in the case of a paste dispenser in which the discharge orifice is directed axially rather than radially and is arranged, for example, in the coaxial extension of the tube section 14 on the housing part 1. The axes of the striping ducts are now parallel to the housing axis 13.

While a specific embodiment of the invention has been shown and described in detail to illustrate the application of the principles of the invention, it will be understood that the invention may be embodied otherwise without departing from such principles.

I claim:

1. A pasty material dispenser comprising: first and second telescopically interengaged cylindrical housing parts, said first and second housing parts together defining parts of a pasty material pump; a bellows of elastic material arranged between and interconnecting said first and second housing parts, said first and second housing parts being telescopically movable relative to each other in axial directions between two limit stroking positions and being returnable from a full stroked position to an initial position by resilient forces produced by said bellows, said first housing part having a tubular discharge orifice in a form which shapes a strand of paste which is discharged therefrom; first and second tubular sections arranged at the interior of said first housing part and defining an annular duct therebetween, said first and second tubular sections being arranged coaxially to said first and second housing parts and being coaxial with said bellows, said bellows having a radially elastic sleeve like annular wall portion extending between said first and second tubular parts and defining a valve therebetween for regulating the flow of striping material between said sections going to said discharge orifice, said second housing part forming a paste reservoir and said first housing part forming striping material reservoir and including at least one discharge duct extending between said striping material reservoir and said discharge orifice and providing a conduit for striping material to said orifice which joins the discharge orifice for the main pasty material.

2. A paste dispenser according to claim 1 wherein said striping ducts have the same direction as the access of said discharge orifice.

3. A paste dispenser according to claim 1 wherein said striping ducts are arranged along the inner face of said discharge orifice.

4. A paste dispenser according to claim 1 wherein said inner tube section is made longer than said outer tube section and has a reduced external diameter concentric to said bellows and spaced inwardly of said bellows.

5. A paste dispenser according to claim 1 including a plurality of striping channels formed between said inner tube section and said discharge orifice.

6. A pasty material dispenser, comprising: first and second telescopically interengaged cylindrical housing parts having a central axis, said first housing part having a strip portion and slidable interengagement with said second housing part, said first housing part having a front closure wall; outer and inner radially spaced tubular walls extending substantially concentrically to said axis; a radially extending discharge orifice formed in said first housing part extending through said outer tubular wall and having an inner end terminating in the interior of said outer tubular wall, said second cylindrical housing part having a radial front wall substantially closing the front end of said second housing part; an outstanding cylindrical nipple on said housing part front wall having an opening for pasty material; bottom means defining a bottom for said second housing part, a space above said bottom means defining a pasty material reservoir; a flexible bellows connected between said outer tubular wall and said nipple, said bellows having an annular conical wall portion extending into resilient engagement with said inner tubular wall and defining a valve between said outer and said inner tubular walls, and said inner tubular wall and said bellows; a plunger member in said inner tubular wall spaced from said front enclosure wall and defining a striping material reservoir between said front closure wall and said plunger member, and at least one striping material duct extending between said striping material reservoir and said plunger member.

7. A pasty material dispenser according to claim 6 wherein said means defining a pasty material striping material comprises a tracking plunger slidable in said second housing part.

8. A paste dispenser according to claim 6 wherein said plunger of said inner tube section comprises a circular disc having a guiding edge in contact with said inner tubular wall.

* * * * *